US008479348B2

(12) United States Patent
DeCarr

(10) Patent No.: US 8,479,348 B2
(45) Date of Patent: Jul. 9, 2013

(54) STAIN APPLICATOR

(75) Inventor: Gary Allan DeCarr, Fort Mill, SC (US)

(73) Assignee: Newell Operating Co., Atlanta, GA (US)

( * ) Notice: Subject to any disclaimer, the term of this patent is extended or adjusted under 35 U.S.C. 154(b) by 252 days.

(21) Appl. No.: 13/134,322

(22) Filed: Jun. 3, 2011

(65) Prior Publication Data

US 2011/0296638 A1 Dec. 8, 2011

(51) Int. Cl.
*B05C 1/06* (2006.01)
*B05C 17/00* (2006.01)

(52) U.S. Cl.
USPC ..... 15/210.1; 15/118

(58) Field of Classification Search
CPC ..... B05C 1/06; B05C 17/00
USPC ..... 15/118, 144.1, 144.2, 209.1, 210.1, 15/220.3, 244.1, 244.2, 248.1; 118/264, 118/505
See application file for complete search history.

(56) References Cited

U.S. PATENT DOCUMENTS

| | | | | |
|---|---|---|---|---|
| 1,437,177 | A * | 11/1922 | Hartman | 15/114 |
| 4,611,941 | A | 9/1986 | Karliner et al. | |
| 4,674,144 | A * | 6/1987 | Palmeri | 15/210.1 |
| 4,822,194 | A | 4/1989 | Simonette | |
| D444,928 | S | 7/2001 | Bruggeman et al. | |
| 7,055,204 | B2 * | 6/2006 | Ajluni | 15/121 |
| 7,192,210 | B2 * | 3/2007 | Svendsen et al. | 401/9 |
| 7,325,990 | B2 | 2/2008 | Svendsen et al. | |
| D611,213 | S | 3/2010 | Markey et al. | |
| 2003/0074754 | A1 * | 4/2003 | Holden | 15/160 |
| 2003/0074760 | A1 | 4/2003 | Keller | |
| 2004/0158949 | A1 * | 8/2004 | Booth et al. | 15/210.1 |
| 2007/0147943 | A1 | 6/2007 | Svendsen et al. | |
| 2009/0100624 | A1 * | 4/2009 | MacCormick | 15/223 |
| 2011/0117284 | A1 * | 5/2011 | Sandahl et al. | 427/429 |

* cited by examiner

*Primary Examiner* — Joseph J Hail
*Assistant Examiner* — Marc Carlson
(74) *Attorney, Agent, or Firm* — Baker & Hostetler LLP

(57) ABSTRACT

A stain applicator comprising a pad frame, a handle assembly attached to an upperside thereof, and an applicator pad wherein said applicator pad includes a slit therein allowing the retraction and extension of an applicator blade frame and attached applicator blade pad to allow staining of both the tops of generally flat decking boards mounted having gaps therebetween and the sides thereof through the extension and retraction of the applicator blade frame and applicator blade pad.

20 Claims, 8 Drawing Sheets

STAIN APPLICATOR

CROSS REFERENCE TO RELATED APPLICATIONS

The present application claims the benefit under 35 U.S.C. §119 to U.S. Provisional Patent Application Ser. No. 61/351,353, filed Jun. 4, 2010 and titled "STAIN APPLICATOR," the disclosure of which is hereby incorporated by reference.

FIELD OF THE INVENTION

The present invention is directed to devices for applying liquids to substrates and, more specifically, to devices for use in applying stain and/or paint to substrates comprised of surfaces made of boards, such as decking boards, having a gap between adjacent boards.

BACKGROUND OF THE INVENTION

Decks generally made of wood decking boards are usually constructed with intentional gaps to allow for water to quickly and easily drain therethrough. These decking boards generally need to be stained or painted fairly frequently. Most prior art stain/paint applicators for these applications have not provided a single apparatus that is useful for allowing a user to paint/stain the flat surfaces of the decking boards while simultaneously allowing for the convenient and easy staining of the sides of the boards through the relatively narrow gaps. Instead, users generally have had to employ the use of separate pad-type applicators along with a conventional brush to apply stain both to the planar surface of the decking boards and to the opposed surfaces thereof formed by the gaps. Accordingly, it would be desirable to have a single deck staining/painting tool which could effectively be used to stain/paint both the flat surface of the decking boards as well as the sides thereof.

SUMMARY OF THE INVENTION

It is a first aspect of the present invention to provide an applicator for stain and/or paint (or paint-like liquids) to a substrate, such as a deck, comprised of boards having a gap between the boards, comprising In a more detailed embodiment of the first aspect, a stain applicator of the present invention preferably includes a pad frame, a handle assembly attached to an upperside thereof, and an applicator pad. The applicator pad preferably has a longitudinal slit therein. Preferably, the stain applicator includes an applicator blade frame and an applicator blade pad attached thereto which is shaped and sized to be extended and retracted through said slit such that a user may use said stain applicator to apply stain to an upperside of deck boards when the applicator blade frame is in a retracted position and wherein a user may use the stain applicator to apply stain to the upperside and sides of the deck boards when the applicator blade frame is in the extended position.

DETAILED DESCRIPTION

Figure 1:
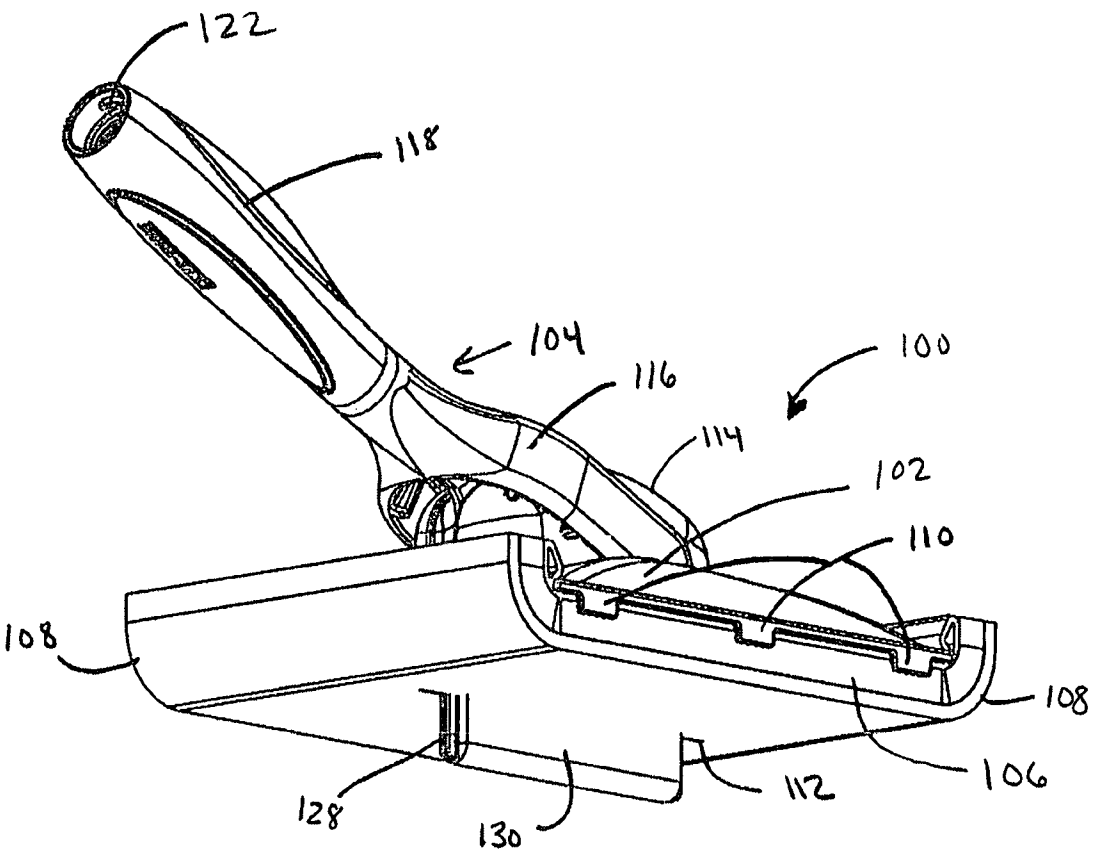
FIG. 1 is a lower side perspective view of an exemplary stain applicator in accordance with the present invention, wherein the applicator blade is shown in a partially extended position.
Figure 2:
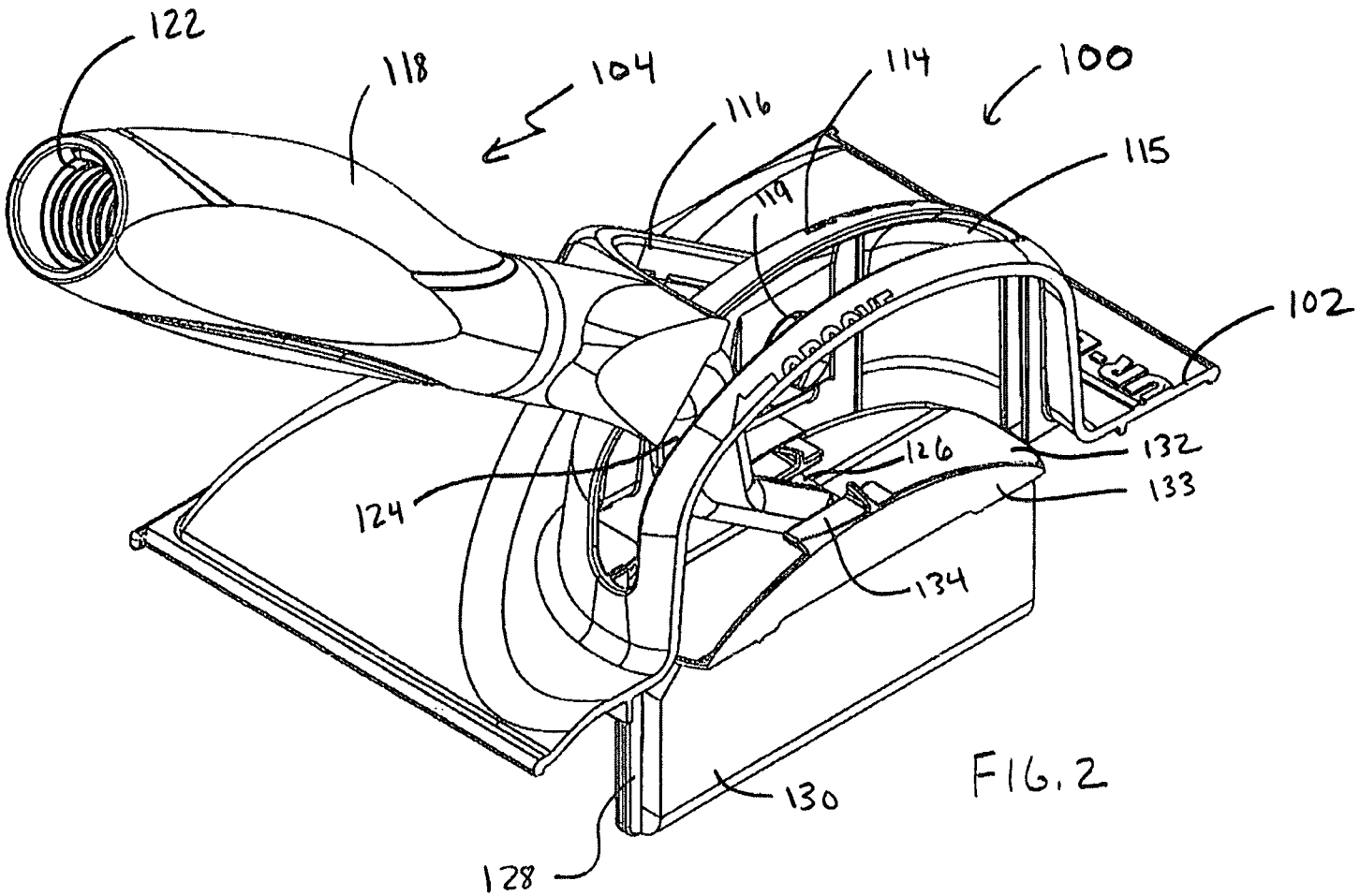
FIG. 2 is a cutaway upper side perspective view of the exemplary stain applicator of FIG. 1, wherein the applicator blade is shown in the fully extended position.

Initially, it is noted that the applicator disclosed and claimed herein maybe referred to as a stain applicator, a person of ordinary skill in the art will readily understand that the applicator of the present invention may be used to apply stain, paint, sealants, etc., without departing from the scope of the invention. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Referencing FIGS. 1-8, an exemplary stain applicator 100 includes a pad frame 102, a handle assembly 104 attached to an upperside thereof, and an applicator pad 106, preferably having rounded leading and trailing edges 108, held thereon (in an exemplary embodiment) by tabs 110. The applicator pad 106 has a longitudinal slit 122 therein. The applicator pad 106 may be made of any suitable material for picking up, holding and dispensing stain and/or paint on to decking boards including, without limitation, foam, fibers, flock, microfiber, bristles and the like and may be disposable or reusable. The pad frame 102 preferably has a housing 114 positioned on an upper portion including a longitudinal groove 115 placed in a center portion thereof and pivot holes 119 positioned on the sides thereof.

In a preferred embodiment, the handle assembly 114 includes a yoke 116 and is attached to the housing 114 by pivots 120 on each end of the yoke 116 that are sized and shaped to be pivotably received in the pivot holes 119. Preferably, the handle assembly 104 also includes a hand grip 118 thereon and may include a threaded portion 122 in an outer extent thereof shaped to receive a threaded end of a handle extension pole (not shown). Preferably, the handle assembly 114 includes a Z-shaped link arm 124 including a head 126 on an end thereof shaped to be received through groove 115 in housing 114. In a preferred embodiment, the head 126 of the Z-shaped link arm 124 is slidably received in a groove formed by sliding plate 132 having upright extensions 133 and inwardly projecting retaining members 134 thereon. Preferably, the plate 132 is integrally formed or attached to an applicator blade frame 128 being sized and shaped to receive an applicator blade pad 130. The Z-shaped link arm 124 may be formed integrally with or attached to handle assembly 104.

The applicator blade pad 130 may be made of any suitable material for picking up, holding and dispensing stain and/or paint on to decking boards including, without limitation, foam, fibers, flock, microfiber, bristles and the like and may be disposable or reusable. The combination of the applicator blade frame 128 and applicator blade pad 130 is preferably ⅜ inches in width which is slightly larger than the typical ⅛ to ¼ inches spacing between decking boards in order for the applicator blade pad 130 to be compressed against the outsides of the decking boards during staining operations. Furthermore, in a preferred embodiment, slit 112 is preferably at least slightly narrower than the width of the applicator blade frame 128 and applicator blade pad 130 so that when the applicator blade pad 130 is retracted and extended through slit 112, the applicator blade pad 130 is able to pick up stain from the sides of the applicator pad 106 for application to the sides of the decking boards.

Figure 3:
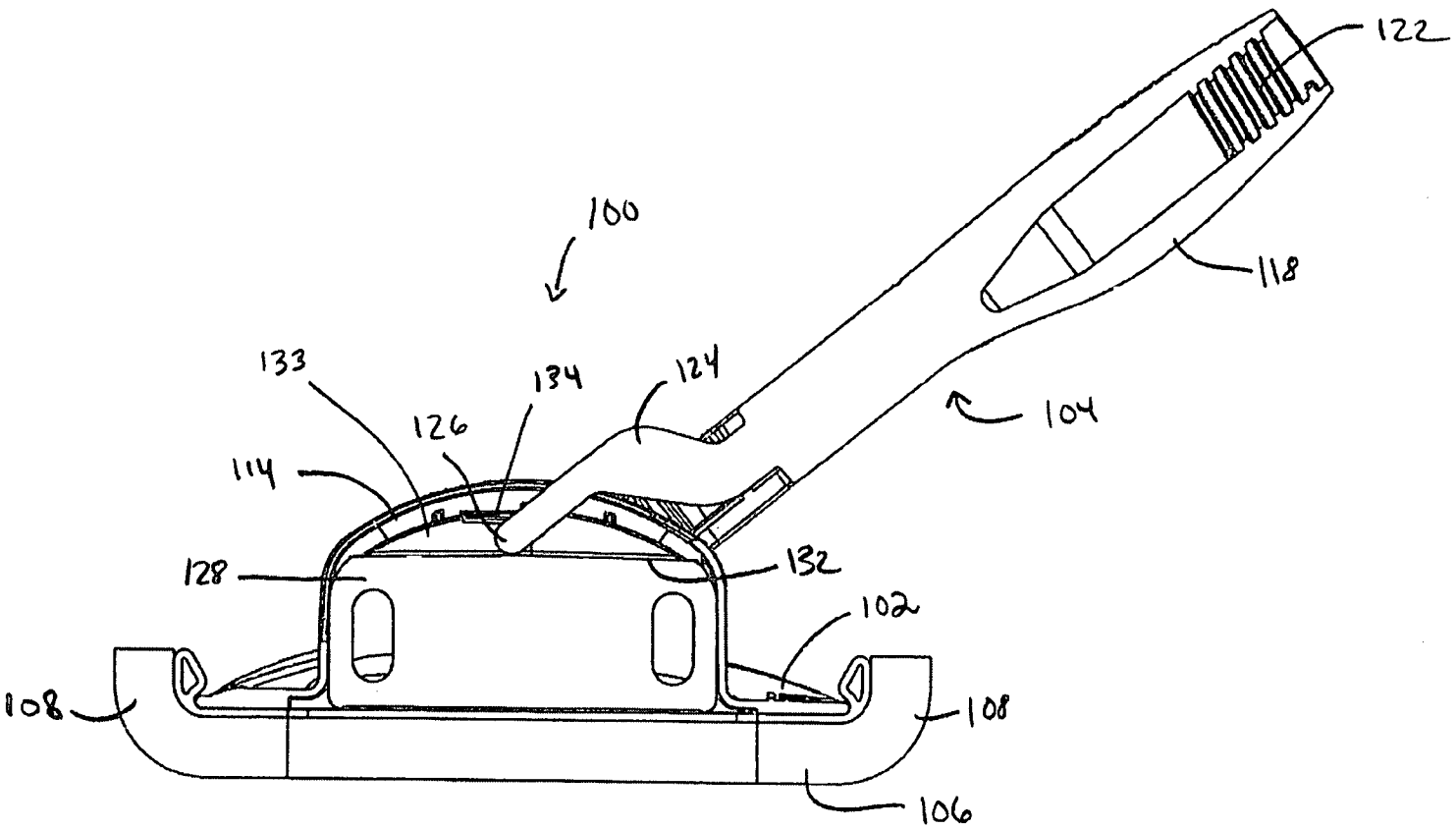
FIG. 3 is a cutaway side elevational view of the exemplary stain applicator shown in FIG. 1 showing the applicator blade in a fully retracted position.
Figure 4:
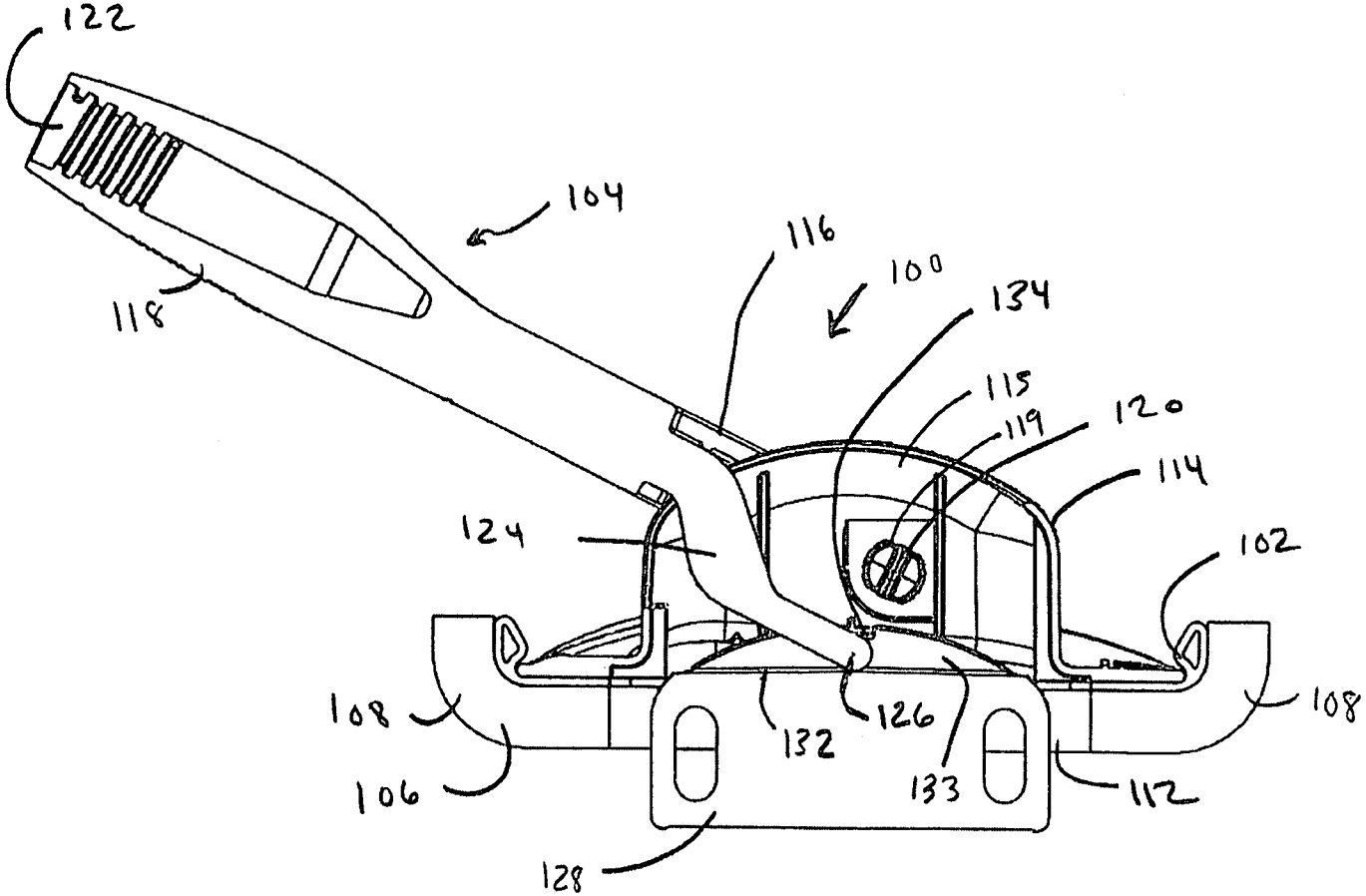
FIG. 4 is a cutaway side elevational view of the exemplary stain applicator shown in FIG. 1 showing the applicator blade in a partially extended position.
Figure 5:
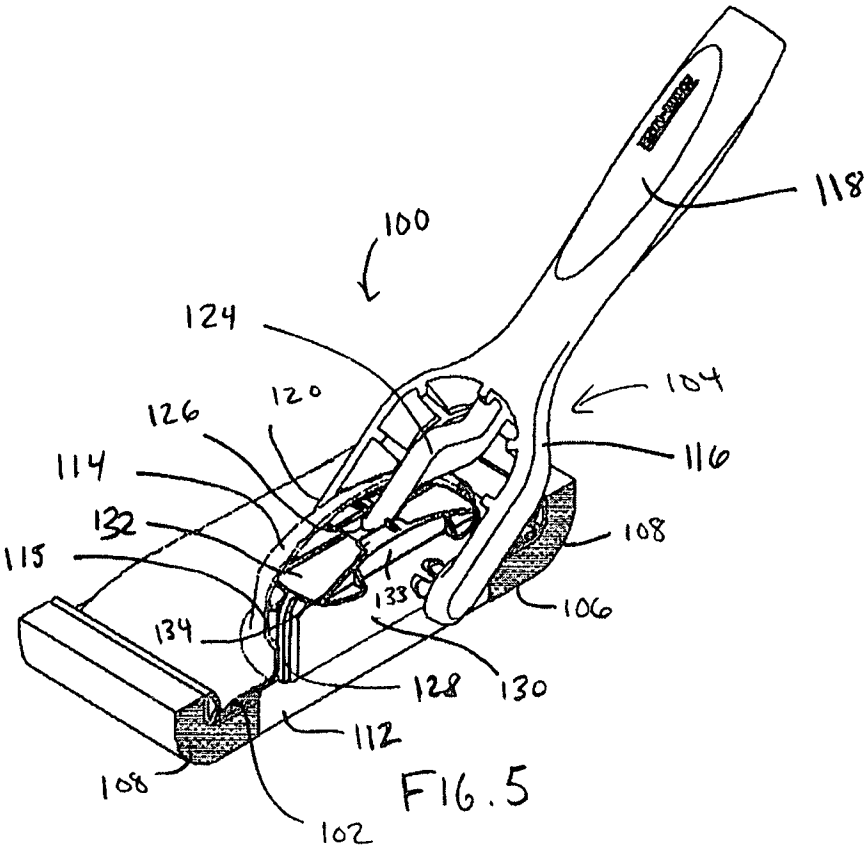
FIG. 5 is a cutaway upper side perspective view of the exemplary stain applicator shown in FIG. 1 showing the applicator blade in a fully retracted position.
Figure 6:
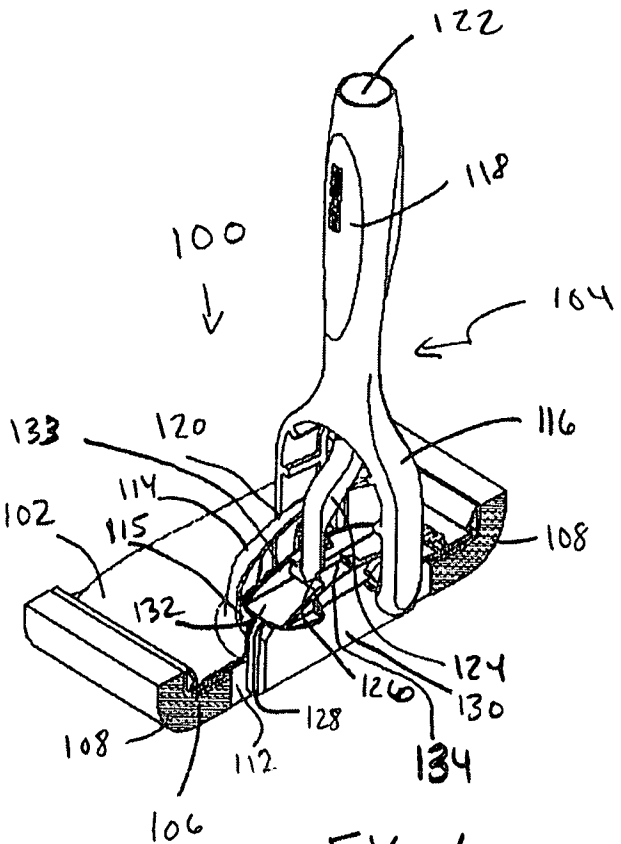
FIG. 6 is a cutaway upper side perspective view of the exemplary stain applicator shown in FIG. 1 showing the applicator blade in a partially extended position.
Figure 7:
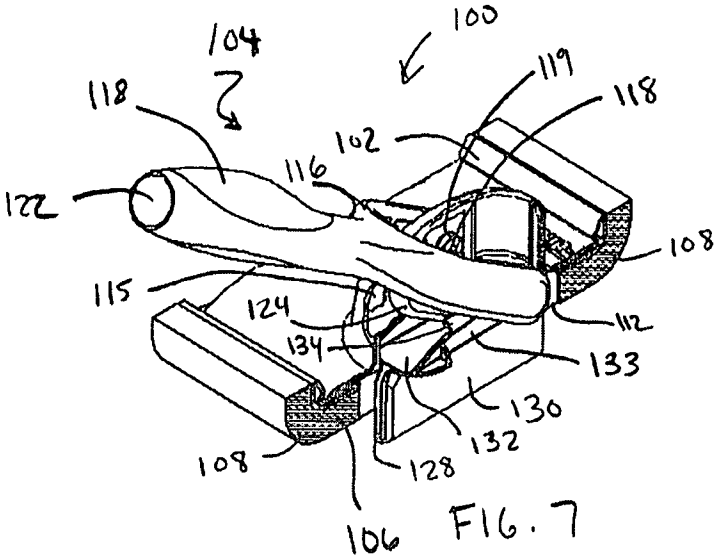
FIG. 7 is a cutaway upper side perspective view of the exemplary stain applicator shown in FIG. 1 showing the applicator blade in a fully extended position.
Figure 8:
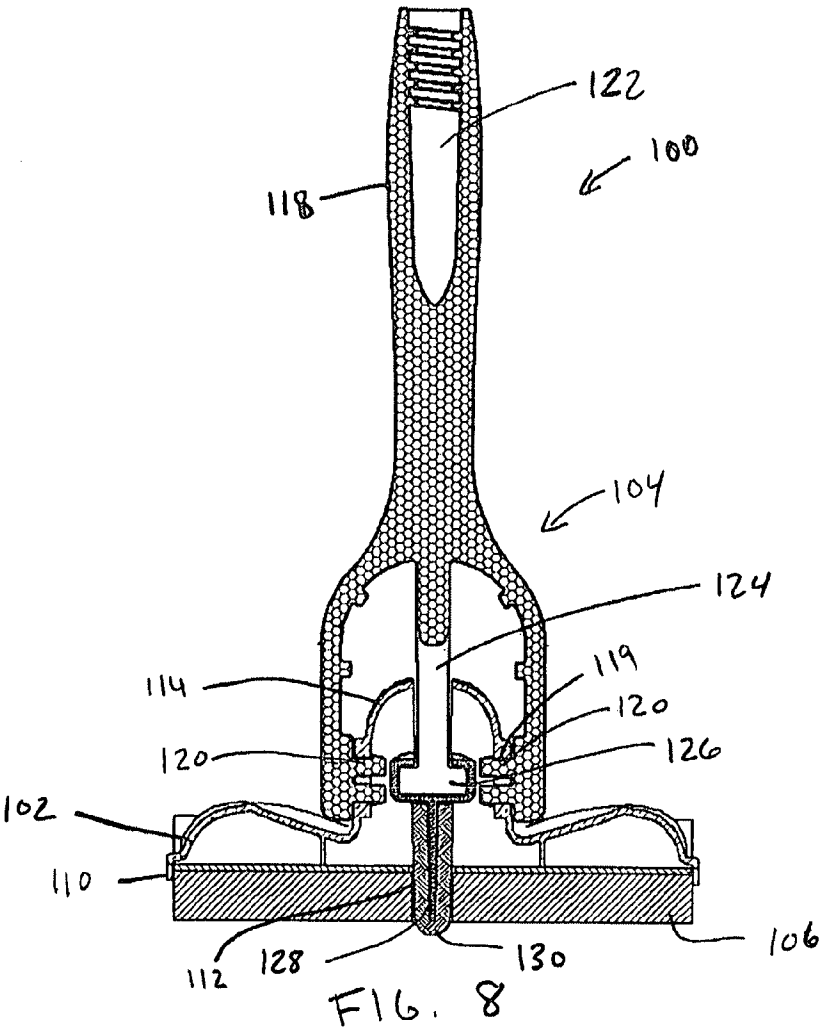
FIG. 8 is a cutaway rear elevation view of the exemplary stain applicator shown in FIG. 1 showing the applicator blade in a partially retracted position.

In operation, the handle assembly 104 may be used to retract and extend the applicator blade frame 128 and applicator blade pad 130 through the use of the camming action provided by the Z-shaped link arm 124. Specifically, as best shown in FIGS. 3 and 5, when the handle assembly 104 is pivoted to the right such that the "Z" of the Z-shaped link arm 124 is right-side up, the head 126 of the Z-shaped link arm 124 is placed at its highest point and, through the force of the head 126 against the retaining members 134 and plate 132, holds the applicator blade frame 128 and applicator blade pad 130 in the fully retracted position. Conversely, as best shown in FIGS. 1, 2, 4 and 6-8, as the handle assembly 104 is pivoted to the left, the camming action of the head 126 against the retaining members 134 and plate 132 extends the applicator blade frame 128 and connected applicator blade pad 130 through the slit 112 to the fully extended position. In the fully left-pivoted position of the handle assembly 104 the "Z" of the Z-shaped link arm 124 is upside down placing the head 126 at its lowest point and, through the force of the head 126 against the retaining members 134 and plate 132, placing the applicator blade frame 128 and applicator blade pad 130 in the fully extended position. In a preferred embodiment, the length of the plate 132 and retaining In accordance with a preferred embodiment as disclosed herein, in use a user would pivot the handle assembly 104 of the stain applicator 100 to the fully retracted position (in the present embodiment, to the right) and then place the applicator pad 106 in a stain reservoir, such as a paint tray or the like. The stain applicator 100 would then be able to be used to stain either the tops and/or the sides of the decking boards. If it was desired to stain the sides of the decking board, the handle assembly 104 would be rotated to the left thereby extending the applicator blade frame 128 while simultaneously loading the applicator blade pad 130 with stain. This process would be repeated until the deck staining job was completed.

It should be understood that the foregoing exemplary embodiment description describes in detail only a single specific structure for providing a stain applicator comprising a generally flat pad and a retractable blade that extends and retracts through a slit in the pad to provide a staining device capable of simultaneously staining the tops of flat decking boards and the sides of the same decking boards provided with gaps therebetween. Other, non-limiting examples of structures that would fall within the scope of the invention include, but are not limited a spring loaded blade structure that may be extended and retracted through well-known mechanical means, other similar and non-similar camming mechanisms that would utilize a similar extending/retracting motion as disclosed herein through slightly different cams/followers, etc. Indeed, a person of ordinary skill in the art would be aware of many similar (and different) structural mechanisms which could achieve the required extending/retracting function of the applicator blade frame and applicator blade pad, all of which would fall within the scope of the present invention.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A stain applicator comprising:

an applicator pad mounted to an applicator pad frame, said applicator pad including a longitudinal slit therein;

a handle assembly operably connected to said pad frame;

an applicator blade frame having an applicator blade pad attached thereto wherein said applicator blade frame and applicator blade pad are shaped and sized to be extended and retracted through said longitudinal slit;

an actuator for extending and retracting said applicator blade frame and said applicator blade pad through said longitudinal slit such that when said applicator blade frame and applicator blade pad are in the extended position, said applicator blade pad may be used by a user to stain the sides of decking boards mounted with spaces between the decking boards and wherein when the applicator blade frame and applicator blade pad are in the retracted position, the surface of the applicator pad is generally planar allowing the user to use said applicator pad to stain the top surface of said decking boards.

2. The stain applicator of claim 1 wherein said actuator includes a link arm.

3. The stain applicator of claim 2 wherein said actuator further includes a sliding plate and said sliding plate is attached to a top portion of said applicator blade frame and said link arm is Z-shaped.

4. The stain applicator of claim 3 wherein said link arm includes an elongated head and said sliding plate includes extensions therefrom and inwardly projecting retaining members on said extensions for slidingly receiving and capturing said link arm head.

5. The stain applicator of claim 1 wherein said applicator pad frame includes a housing thereon and said handle assembly includes a yoke and said yoke is pivotably attached to said housing.

6. The stain applicator of claim 5 wherein said housing is sized and shaped to receive said applicator pad frame when said applicator pad frame is fully retracted and said housing includes a longitudinal groove therein.

7. The stain applicator of claim 6 wherein said yoke includes a link arm attached to medial portion thereof and said longitudinal groove is sized and shaped to receive said link arm.

8. The stain applicator of claim 7 wherein said actuator further includes a sliding plate and said sliding plate is attached to a top portion of said applicator blade frame and said link arm is Z-shaped.

9. The stain applicator of claim 8 wherein said link arm includes an elongated head and said sliding plate includes extensions therefrom and inwardly projecting retaining members on said extensions for slidingly receiving and capturing said link arm head.

10. The stain applicator of claim 1 wherein said applicator pad is removably attached to said applicator pad frame.

11. The stain applicator of claim 1 wherein said applicator blade pad is removably attached to said applicator blade frame.

12. The stain applicator of claim 1 wherein said applicator pad has rounded leading and trailing edges.

13. The applicator pad of claim 1 wherein said handle assembly includes a threaded portion on and end thereof.

14. A stain applicator comprising:

an applicator pad mounted to an applicator pad frame, said applicator pad including a longitudinal slit therein;

a handle assembly operably connected to said pad frame;

an applicator blade frame having an applicator blade pad attached thereto wherein said applicator blade frame and applicator blade pad are shaped and sized to be extended and retracted through said longitudinal slit;

an actuator for extending and retracting said applicator blade frame and said applicator blade pad through said longitudinal slit such that when said applicator blade frame and applicator blade pad are in the extended position, said applicator blade pad may be used by a user to stain the sides of decking boards mounted with spaces between the decking boards and wherein when the applicator blade frame and applicator blade pad are in the retracted position, the surface of the applicator pad is generally planar allowing the user to use said applicator pad to stain the top surface of said decking boards, said actuator being comprised of a link arm attached to said handle assembly such that rotation of said handle assembly causes extension and retraction of said applicator blade frame.

15. The stain applicator of claim 14 wherein said actuator further includes a sliding plate and said sliding plate is attached to a top portion of said applicator blade frame and said link arm is Z-shaped.

16. The stain applicator of claim 15 wherein said link arm includes an elongated head and said sliding plate includes extensions therefrom and inwardly projecting retaining members on said extensions for slidingly receiving and capturing said link arm head.

17. The stain applicator of claim 14 wherein said applicator pad frame includes a housing thereon and said handle assembly includes a yoke and said yoke is pivotably attached to said housing.

18. The stain applicator of claim 14 wherein said applicator pad is removably attached to said applicator pad frame.

19. The stain applicator of claim 1 wherein said applicator blade pad is removably attached to said applicator blade frame.

20. A stain applicator comprising:

an applicator pad removably mounted to an applicator pad frame, said applicator pad including a longitudinal slit therein and said applicator pad frame including a housing thereon having a longitudinal groove therein;

a handle assembly comprised of a yoke pivotably connected to said housing;

an actuator comprised of a Z-shaped link arm attached to a medial portion of said handle yoke and an applicator blade frame having an applicator blade pad attached thereto, said applicator blade frame having a sliding plate attached to a top portion of said applicator blade frame wherein said link arm includes an elongated head and said sliding plate includes extensions therefrom and inwardly projecting retaining members on said extensions for slidingly receiving and capturing said link such that when said handle assembly is rotated said applicator blade frame and said applicator blade pad are extended or retracted through said longitudinal slit such that when said applicator blade frame and applicator blade pad are in the extended position, said applicator blade pad may be used by a user to stain the sides of decking boards mounted with spaces between the decking boards and wherein when the applicator blade frame and applicator blade pad are in the retracted position, the surface of the applicator pad is generally planar allowing the user to use said applicator pad to stain the top surface of said decking boards.

* * * * *